United States Patent [19]

Queiser et al.

[11] Patent Number: 4,655,968

[45] Date of Patent: Apr. 7, 1987

[54] METHOD AND FURNACE FOR REMOVING TOXIC, ESPECIALLY RADIOACTIVE WASTES

[75] Inventors: Horst Queiser, Bruchköbel; Siegfried Meininger, Altenstadt; Karl-Heinz Kleinschroth, Frankfurt, all of Fed. Rep. of Germany

[73] Assignee: Kraftwerk Union Aktiengesellschaft, Mülheim, Fed. Rep. of Germany

[21] Appl. No.: 670,373

[22] Filed: Nov. 9, 1984

[30] Foreign Application Priority Data

Nov. 18, 1983 [DE] Fed. Rep. of Germany ..... 3341748

[51] Int. Cl.[4] ..... G21F 9/32; G21F 9/08; F23B 5/04

[52] U.S. Cl. ..... 252/632; 110/237; 110/238; 110/250; 110/252; 110/342; 110/345; 110/346; 159/47.3; 159/DIG. 12; 252/626; 252/631; 422/903

[58] Field of Search ..... 252/626, 631, 632; 110/237, 238, 250, 252, 346, 253, 342, 251, 343, 344, 345; 159/47.3, DIG. 12, DIG. 1; 422/903

[56] References Cited

U.S. PATENT DOCUMENTS

| | | | |
|---|---|---|---|
| 3,922,974 | 12/1975 | Hempelmann | 110/237 |
| 4,053,432 | 10/1977 | Tiepel et al. | 252/632 |
| 4,499,833 | 2/1985 | Grantham | 252/631 |
| 4,526,712 | 7/1985 | Hirano et al. | 252/632 |
| 4,582,004 | 4/1986 | Fey et al. | 252/626 |

OTHER PUBLICATIONS

German Publication "Atomwirtschaft", Jul. 1976.

*Primary Examiner*—Stephen J. Lechert, Jr.
*Assistant Examiner*—Howard J. Locker
*Attorney, Agent, or Firm*—Herbert L. Lerner; Laurence A. Greenberg

[57] ABSTRACT

Radioactive wastes are treated in a furnace which has electrodes for electric heating. The furnace has at the lower end an outlet for slag material as well as a gas discharge line. Its well is a self-supporting tubular body which is arranged detachably in a metal furnace housing. At the upper end of the well is a line for feeding water. Thereby, carbon-containing waste, possibly also carbon of a carbon bed, is reacted to form water gas ($CO+H_2$), which is burned after purification in an exhaust gas plant. The outlet of the metal housing has a movable grate.

5 Claims, 2 Drawing Figures

METHOD AND FURNACE FOR REMOVING TOXIC, ESPECIALLY RADIOACTIVE WASTES

BACKGROUND OF THE INVENTION

1. Field of the Invention

The invention relates to a method of treating toxic and in particular radioactive wastes containing oxidizable components in an electrically heated furnace while an oxidizing agent is being supplied and by incineration. The gaseous end products are processed in an exhaust gas installation and solid residues are filled into containers. The invention further relates to a furnace for treating radioactive wastes by heating them in a housing having a well of refractory material, which is connected to two electrodes, a charging opening for wastes being provided at the upper end of the housing and an outlet for slag material at the lower end.

2. Description of the Prior Art

Heating can take place in a furnace in different ways, for instance, by the exothermic reaction of normal combustion. Electrical heating for treating radioactive wastes, using two electrodes, is provided, as is described, for instance, in the journal "Atomwirtschaft", July 1976, pages 352 to 356 "Treatment of Highly Radioactive Wastes". This involves the vitrification of highly radioactive wastes.

Electric heating is also involved in other furnaces for treating carbon-containing wastes, e.g., wood, residential garbage or the like, the purpose of which is gasification for energy recovery. The wastes are heated by a carbon bed which is connected to two electrodes. The heating leads to a reduction of the volume. Therefore, a small outlet for slag material is provided at the lower end of the furnace. For the discharge of gases, the furnace is enlarged approximately in the middle to form a ring canal, from which a gas discharge line starts.

SUMMARY OF THE INVENTION

An object of the invention is to provide an efficient method of treating toxic and/or radioactive wastes containing oxidizable components to remove a reduced volume (compared to the feed waste volume) of solids containing non-volatile toxic, especially radioactive wastes.

A further object of the invention is to gasify the oxidizable components by oxidizing them with an oxidizing agent and thereby reduce the solids content of the wastes.

A still further object is to employ a scrubbing liquid which removes entrained solids from gasified waste products and then is returned as an oxidizing agent, thereby effecting purification of the gaseous products, collection and concentration of the solids, and oxidation by the oxidizing agent.

Another object of the invention is to provide a furnace for treating toxic and/or radioactive wastes in which problems of high maintenance and repair as well as unreliability of the furnace due to wear by the combustion process are minimized.

With the foregoing and other objects in view, there is provided in accordance with the invention a method for treating toxic and in particular, radioactive wastes containing oxidizable components to remove as solids residue, a reduced volume compared to the feed waste volume of solids, which solids residue carry with them the toxic constituents in the feed waste, which comprises; subjecting the feed toxic waste containing oxidizable components to degasification in a first temperature zone of 200° to 400° C. in an electrically heated furnace, passing the degassed wastes from the first temperature zone into a second temperature zone in the furnace at above 800° C., passing gases from the first temperature zone into the second temperature zone in intimate contact with the wastes therein, subjecting the waste in the second zone to pyrolysis and reaction with the gases therein to gasify a material portion of the wastes leaving a reduced volume of residual solids containing the toxic constituents, discharging the residual solids, and separately discharging the gaseous products from the second temperature zone and burning said gaseous products outside the furnace with oxygen.

In accordance with the invention, there is provided a furnace for treating wastes by heating them, comprising a metal furnace housing, a well of refractory material which is connected to electrodes in the housing, a charging opening for wastes at the upper end of the housing, an outlet for slag material at the lower end of the housing, the combination therewith wherein the well is a self-supporting tubular body which is detachably arranged in the metal housing; an opening at the upper end of the well; a cover in the metal housing which cover has a larger cross section than the cross section of the tubular body and can close said opening.

Other features which are considered as characteristic for the invention are set forth in the appended claims.

Although the invention is illustrated and described herein as embodied in a method and furnace for removing toxic, especially radioactive wastes, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

Detailed Description of the Invention

Figure 1:
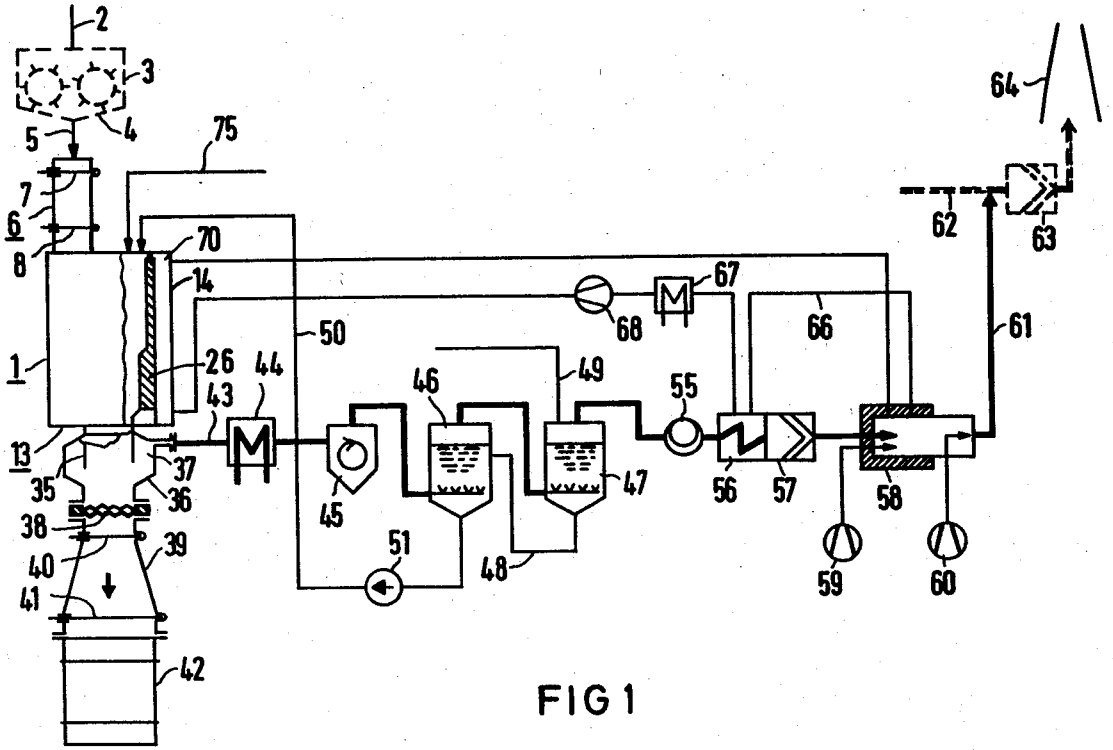
FIG. 1 diagrammatically illustrates apparatus for carrying out the process according to the invention of treating toxic and/or radioactive wastes in an electrically heated furnace while an oxidizing agent is being supplied in two temperature zones and burning the furnace gases outside the furnace with oxygen.

The wastes are first degassed in a first temperature zone of 200° to 400° C. The degassed wastes are conducted through a second temperature zone above 800° C. The gases are conducted from the first temperature zone through the second temperature zone. The exhaust gases from the furnace are burned outside the furnace with oxygen.

The invention starts out from the fact that the activity carriers usually are present as solids, so that concentrating the radioactive wastes to the extreme results in the smallest volume of solids containing radioactive constituents for a secure ultimate storage. In the invention, this purpose of concentrating the radioactive constituents in a small volume of solids is, to a large extent, accomplished by the gasification, by means of which large amounts of the wastes are discharged as gases after pyrolytic conversion in the presence of an oxidizing agent. The combustion of the gasified components, which by themselves may be poisonous or present the danger of an explosion in the unburned condition, render them innocuous in that they do not require secured storage, but can be discharged into the atmosphere. The radioactivity remains in the solids, the residual volume of which is only a few percent of the original quantity of the wastes.

In an exhaust gas installation following the electric furnace, the gases from the furnace should be purified prior to the combustion and, in particular, scrubbed, because solid particles entrained in the gases which still could act as activity carriers can thereby be held back. Such solids are advantageously removed particularly by directing the scrubbing water via the first temperature zone of the furnace, into the second temperature zone of the furnace. Activity carriers contained in the scrubbing water are thereby given off to the solids in the furnace, thus eliminating any problem concerning disposal of waste water. The scrubbing water influences the pyrolysis in the furnace, for instance, it contributes to the reaction of carbon to water gas ($CO+H_2$).

The burned gases, i.e. the combustion products resulting from burning the combustible gases from the furnace with oxygen, can be returned, at least partially, to the furnace. These gases which are inert can be utilized, for instance, in a furnace jacket surrounding the temperature zones form a layer under controlled pressure conditions shielding the interior of the furnace, which prevents the emission of radioactivity or the undesired penetration of oxygen. The burned gases can also be conducted through the furnace jacket for cooling. Other inert gases, e.g. nitrogen, can also be used for the same purpose.

The returned burned gases from the combustion chamber can also be used for preheating the incoming gases to be burned. This is particularly advantageous if the preheated gases are subsequently conducted through aerosol filters, the effectiveness of which increases due to the reduced relative humidity of the incoming gases as a result of the preheating.

The invention further relates to furnaces of the type mentioned at the outset and such furnaces are also usable for the treatment of radioactive wastes. Problems arise in the treatment of radioactive wastes in a furnace for the reason that the wastes can lead to a concentration of the radioactivity in the region of the furnace, which adversely affects the wear, maintenance and repair of the furnaces. In addition, the furnace in accordance with the present invention is suitable for treatment of a multiplicity of radioactive waste materials, for instance, liquid or liquid-containing waste materials in sludge form.

The furnace, according to the invention, has a well which is a self-supporting tubular body detachably arranged in a metal housing. At the upper end of the well, is an opening which can be closed by a cover. The latter has a cross section larger than the cross section of the tubular body.

By virtue of the furnace of the present invention the part of the furnace which is stressed most by the waste materials and the heat, can be replaced easily. Thereby, the radioactivity exposure of the personnel can be kept within limits. In other words, contrary to fixed furnaces with a conventional masonry well, the self-supporting tubular body can be lifted out of the furnace before a permissible given activity is exceeded and is either removed securely or is prepared for further use by a decontamination treatment. The removal can be accomplished particularly easily if the tubular body is made with its external dimensions smaller than the inside dimensions of a standardized storage container (standard barrel). During replacement, it is merely inserted in its entirety into the storage container by a lifting device and then put, optionally after fixation with cement, in intermediate or ultimate storage.

To enable the self-supporting tubular body which is preferably in the form of a ceramic body, to withstand the stress of insertion into the metal housing of the furnace, particularly when it is being lifted out and transported off, the tubular body is desirably additionally covered and/or armored with a sheet-metal jacket, for instance, with steel or fiberglass inserts.

An annular gap between the metal housing and the tubular body can advantageously be provided with thermal insulation. This may be a gas atmosphere, for instance, nitrogen, also vacuum or metallizations may be employed. The annular gap can advantageously be connected to an exhaust gas line of the metal housing, so that the exhaust gas forms the inert atmosphere.

The ring gap allows a fast interchange of the tubular body with another tubular body. The exchange of tubular bodies may be made by remote control to avoid radiation exposure. If required, however, the thermal insulation in the annular gap can also be accomplished by known insulating materials such as glass cotton, foil insulation or the like, which allow lateral fixation of the tubular body and are preferably likewise made readily detachable.

The tubular body advantageously rests on internal brackets of the metal housing. The brackets are designed so that they make heat conduction bridges as small as possible. One electrode may be a ring electrode arranged below the brackets. It is thereby relieved of the weight of the tubular body. This is especially advantageous if the ring electrode mounted in a cup is insertable into the metal housing from below. Optionally, the cup forms this electrode and connects the electrode to the tubular body without a gap.

The tubular body can be set under pressure by the cover forming the top side of the metal housing via deformable intermediate members for mechanically fixing the cover to the tubular body. A sealing ring, for instance, in the form of a woven asbestos fabric is eminently suitable as such an intermediate member.

The cover may be provided with an electrode supported movably, transversely to the surface of the cover. The mobility of the electrode is to permit the uniform introduction of energy to compensate for the burnoff of the electrode. It is advantageous if the electrode is mounted eccentrically in the cover and is arranged, inclined or curved, such that its lower end lies in the axis of the tubular body. Thereby, the room for charging the furnace is increased contrary to the case in which the electrode is arranged totally in the axis of the furnace.

In a further advantageous embodiment of the invention a movable grate is provided underneath the tubular body. The grate may also serve as a closable outlet of the metal housing. However, it can also be supplemented by a seal which follows in the output direction, for instance, a sliding valve or even a lock chamber. In any case, the movable grate makes it possible to loosen the material contained in the furnace, which prevents sticking. This is important because in the treatment of radioactive wastes, the accessibility is limited so that loosening of the furnace content would ordinarily require special precautionary measures.

Figure 2:
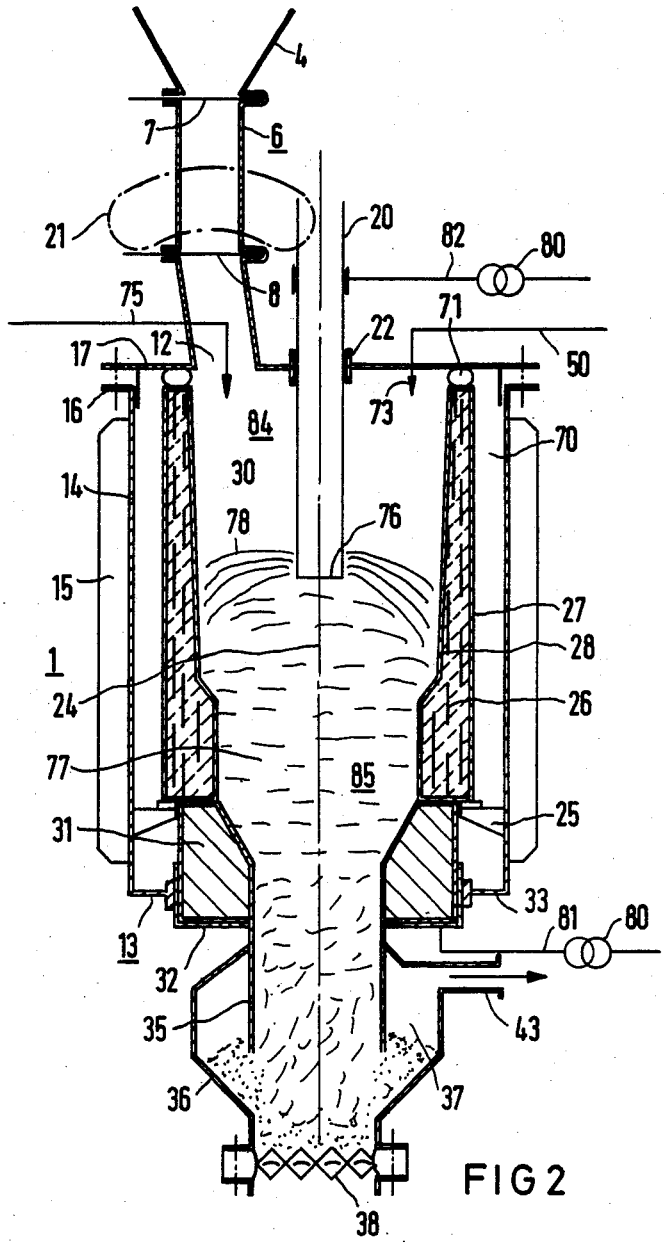
FIG. 2 is an enlarged vertical section of the furnace in FIG. 1 showing a cylindrical furnace housing, an inner tubular ceramic body, a central upper movable graphite electrode, a lower ring electrode, inlets for feed wastes and scrubbing liquor, and outlets for water gas and residue solids.

To explain the invention in greater detail, an embodiment example will be described with the aid of the attached drawings, where in FIG. 1, a device for treating waste according to the invention is shown schematically. FIG. 2 shows a vertical section, enlarged, through the furnace of the device.

An essential element of the device is a furnace 1. It is supplied via a line 2 from a storage source, not shown, with combustible radioactive wastes which, if necessary, are comminuted in a mill 3, shown in dashed lines. The wastes from mill 3 are metered into a charging funnel 4. Funnel outlet 5 leads into a lock 6 with two lock gates 7 and 8 which control the amount and rate of feed to furnace 1 and also seal off the furnace from the outside atmosphere. Continuous operation of the furnace is desired, and the quantity of waste treated depends primarily on the size of the furnace, and less on the type of waste. In the embodiment example, weak- to medium-active waste of any consistency is processed at about 50 kg/h.

The outlet of the lock 6 leads to a charging opening 12 in a metallic furnace housing 13. Housing 13 has a cylindrical steel jacket 14 with vertical fins 15 extending from the outside of the housing 13 (FIG.2). The smooth inside of the jacket 14 has a diameter of 700 to 750 mm. A flat cover 17 is bolted to a flange 16 at the upper end of the steel jacket 14. The charging opening 12 is left open in the cover 17.

To obtain a cross section as large as possible, the charging opening 12 can be curved around the central graphite electrode 20 as is indicated by dash-dotted lines 21. The electrode 20 is arranged movably in a guide 22. The electrode 20, however, can also be arranged outside the axis 24, shown in dash-dotted lines, of the housing 13, to permit a large cross section of the charging opening 12 in the cover 17.

Brackets 25 attached on the inside of the jacket 14, are distributed over the circumference of the jacket. The brackets 25 support a tubular ceramic body 26 which has a cylindrical outside wall and which is provided with a sheet-metal envelope 27 and with the inside profile 28 which increases in thickness by gradation and in steps downward as can be seen from FIG. 2.

The diameter of the cylinder is 650 mm; its height is about 800 mm. The tubular body 26 defines a well 30, into which an electrode 20 protrudes. At the lower end of the well 30 is a ring electrode 31. The latter may be formed of compacted carbon-iron and arranged in a cup 32 which is mounted by sliding the electrode 31 in the underside 33 of the housing 13. The electrode 31 is pushed with the cup 32 against the tubular body 26 from below, to make a connection without a gap.

The inside diameter of the ring electrode 31 is smaller than the smallest diameter of the tubular body 26. The inside diameter extends down into a discharge tube 35 which leads into an enlarged discharge funnel 36 which forms an annular space 37 surrounding the discharge tube 35. A movable grate 38 is attached to the lower end of the funnel 36. Grate 38 serves as a closable outlet for slag material which can be discharged into a barrel 42 via an output lock 39 with the shut-off sliders 40 and 41.

An exhaust gas line 43 is attached to the topside of the funnel 36. It leads via a cooler 44 into a centrifugal separator 45. About 110Nm$^3$/h gaseous products carrying some entrained solid particles are discharged from the annular space 37 through the exhaust gas line 43.

The centrifugal separator 45 to effect at least partial removal of some of the coarser particles, is followed by two series-connected gas scrubbers 46 and 47 with about 150 1 washing liquor each, which are interconnected via a liquid line 48. The line 48 leads from the underside of the gas scrubber 47 to the upper region of the liquid in the gas scrubber 46 feeding liquid from scrubber 47 to scrubber 46. A gas line starts from the top side of the gas scrubber 46 and opens into the lower part of the gas scrubber 47, thereby subjecting the gaseous products which have been washed in scrubber 46 to another washing in scrubber 47. The gas scrubber 47 is replenished with washing liquor, for instance, fresh water from a line 49, because the washing liquor is transported in an amount of up to about 15 1/h from the gas scrubber 46 into the furnace 1 via a line 50 by a pump 51. Thereby, gas scrubbing counterflow-wise to the washing liquor is obtained.

The scrubbed gases are sent from the gas scrubber 47 by a water ring pump 55 and transported via a preheater 56 and a fine filter 57 (aerosol filter) into a combustion chamber 58. The water ring pump 55 provides further gas purification due to its intimate mixing of the exhaust gases with the ring water. A pump 59 supplies the combustion chamber 58 with about 165 Nm$^3$/h combustion air. The approximately 400 Nm$^3$/h of exhaust gases formed thereby are mixed for cooling in the ratio 1:3 with the air supplied by a pump 60. Thus, about 1600 Nm$^3$/h are transported through line 61 to an output air line 62 which latter, after first connecting to a filter 63, leads to a flue 64.

A line 66 leads from the combustion chamber 58 via the preheater 56, a cooler 67 and a pump 68 into the annular gap 79 between the outside 27 of the tubular body 26 and the mirror-coated interior of the jacket 14. The annular gap 70 into which combustion gases from combustion chamber 58 are introduced, thereby forms a heat insulation which surrounds the tubular body and at the same time prevents air which forms a flammable mixture with combustible gases from entering the well 30.

A sealing ring 71, for instance, in the form of an asbestos cord is placed as a resilient spacer on the top side of the tubular body 26. The sealing ring 71 provides a downward force in the vertical direction produced by the fact that the cover 17, when bolted on, presses the tubular body 26 onto the brackets 25. The line 50 is for the supply of process water through an opening in the cover 17. A nozzle 73 as an outlet at the end of line 5 directs the process water from the underside of the cover 17 into the interior of the well 30. The nozzle 73 is preferably designed to uniformly distribute the water charge across the cross-sectional area of the well 30, especially at the edge in the vicinity of the tubular body 26.

Liquid waste matter, for instance, organic liquids, oils, solvents or the like which are to be treated in the furnace 1 are fed in through another line 75 which also passes through the cover 17 into the well 30 from above.

Normally, the well 30 is piled up to the upper end 76 of the electrode 20 with a carbon charge 77, the domed top side of which is indicated at 78. The carbon serves as an electrically conductive material for initiating the heating by electric current. To this end, a voltage of, for instance, 40 v is applied on one side by a transformer 80 via a line 81 to the cup 32 with the ring electrode 31. The other end of the transformer is connected via the line 82 to the electrode 20. The voltage is controlled as a function of the furnace temperature.

The electric heating in the carbon charge in the form of resistance heating is utilized in the invention in two temperature zones. In the first temperature zone 84 above the carbon charge 77 at temperatures of 200° to 400° C., degassing of the radioactive wastes occurs. In the process, organic compounds are decomposed down to the carbon skeleton (low temperature carbonization coke). Subsequently, the residues (low-temperature carbonization coke, metals, minerals, etc.) are gasified in a second temperature zone 85 at temperatures above 1000° down to an incombustible residue. The well-known water gas reaction ($C+H_2O \rightarrow CO+H_2$) is obtained by the introduction of the process water through line 50 which enters temperature zone 85 as steam and supplements the water accumulating with the waste. Water gas formed in zone 85 is discharged through line 43, together with the gas liberated or generated in zone 84, which latter gas passes down into zone 85 and reacted there, at least partially.

The remaining solids of the wastes in an amount of 1 to 1.5 kg/h collect on the movable grate 38 and are discharged therefrom. An advantageous loosening of the material contained in the well 30 is achieved by the motion of the grate 38. After the slider 40 is opened, the solids from grate 38 collect in chamber 39 and after the slider 41 is opened, the solids in chamber 39 drop into the standard barrel 42 which may contain a concrete insert for shielding higher activities, or is provided with outside shielding.

With the new method, combustible radioactive wastes are reduced down to a few percent of the original volume. The activity is bound practically exclusively to the small solids volume. If the water used for scrubbing the gas is more heavily contaminated by acid residues such as chlorine or sulfur, which are enriched in the closed loop, an alkalization can be performed as a remedy. The salts produced thereby are deposited on the waste solids, and they will be discharged with the latter.

Such harmful acidic substances can also be bound by the addition of lime into the combustion chamber, optionally together with the wastes.

The described furnace 1 is eminently suitable for treating different radioactive wastes, especially since the furnace itself, and also the auxiliary equipment therewith for the gas purification are of relatively small dimensions and weights, enabling the entire device with a support frame to be accommodated in a housing and thereby made mobile. Thereby, the new furnace with its readily replaceable tubular body could be employed at other locations, for instance, for heating aggressive chemicals, which may be of interest for the protection of the environment.

The foregoing is a description corresponding, in substance, to German application P No. 33 41 748.2, dated November 18, 1983, international priority of which is being claimed for the instant application and which is hereby made part of this application. Any material discrepancies between the foregoing specification and the specification of the aforementioned corresponding German application are to be resolved in favor of the latter.

There is claimed:

1. Method for treating toxic and in particular, radioactive wastes containing oxidizable components to form from such toxic waste feed solids residue of a reduced volume compared to the volume of solids in the waste feed, which solids residue carry with them the toxic constituents in the feed waste, and also to produce from the toxic waste feed a separate gaseous products substantially free of toxic constituents which comprises; subjecting the feed toxic waste containing oxidizable components to degasification in a first temperature zone of 200° to 400° C. in an electrically heated furnace, passing the degassed wastes from the first temperature zone into a second temperature zone in the furnace at above 800° C., passing gases from the first temperature zone into the second temperature zone in intimate contact with the wastes therein, subjecting the waste in the second zone to pyrolysis and reaction with the gases therein to gasify a material portion of the wastes leaving a reduced volume of residual solids containing the toxic constituents, discharging the residual solids, and separately discharging the gaseous products from the second temperature zone and burning said gaseous products outside the furnace with oxygen.

2. Method according to claim 1, wherein the gaseous products are scrubbed with water prior to said burning and that the scrubbing water is conducted via the first into the second temperature zone of the furnace.

3. Method according to claim 1, wherein a slight underpressure is maintained in the interior of the furnace.

4. Method according to claim 1, wherein combustion gases from said burning are returned, at least partially, to the furnace and that the returned gases are used for preheating the gases to be burned.

5. Method according to claim 4, wherein the preheated gases are conducted through an aerosol filter.

* * * * *